US008913906B2

(12) United States Patent
Suzuki et al.

(10) Patent No.: US 8,913,906 B2
(45) Date of Patent: Dec. 16, 2014

(54) IMAGE FORMING APPARATUS HAVING ENDLESS BELT TENSION DETECTION

(75) Inventors: Akimichi Suzuki, Yokohama (JP); Takao Nada, Numazu (JP); Shinya Kawakami, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 13/542,273

(22) Filed: Jul. 5, 2012

(65) Prior Publication Data

US 2013/0016984 A1 Jan. 17, 2013

(30) Foreign Application Priority Data

Jul. 11, 2011 (JP) ..... 2011-152847

(51) Int. Cl.
*G03G 15/00* (2006.01)
*G03G 15/16* (2006.01)
*G03G 15/01* (2006.01)

(52) U.S. Cl.
CPC ..... *G03G 15/1615* (2013.01); *G03G 15/0189* (2013.01)
USPC ..... 399/39; 399/66; 399/121; 399/297; 399/308; 198/813; 198/814

(58) Field of Classification Search
CPC ..... G03G 15/1615; G03G 15/0189; G03G 2215/00156
USPC ..... 399/36, 38, 101, 121, 165, 167, 297, 399/299; 198/813, 814
See application file for complete search history.

(56) References Cited

U.S. PATENT DOCUMENTS

| | | | | |
|---|---|---|---|---|
| 7,155,144 | B2 * | 12/2006 | Atwood et al. | 399/165 |
| 7,593,664 | B2 * | 9/2009 | Okabe | 399/101 |
| 2007/0059055 | A1 * | 3/2007 | Iwata | 399/302 |
| 2007/0147894 | A1 * | 6/2007 | Yokota | 399/165 |
| 2011/0194879 | A1 | 8/2011 | Nomura et al. | |
| 2012/0207494 | A1 | 8/2012 | Tomura et al. | |
| 2013/0016983 | A1 * | 1/2013 | Kawakami | 399/38 |

FOREIGN PATENT DOCUMENTS

| | | | |
|---|---|---|---|
| JP | 2007-164086 | A | 6/2007 |
| JP | 2008-145680 | A | 6/2008 |
| JP | 2012123044 | A * | 6/2012 |

* cited by examiner

*Primary Examiner* — Francis Gray
(74) *Attorney, Agent, or Firm* — Fitzpatrick, Cella, Harper & Scinto

(57) ABSTRACT

An image forming apparatus includes an image bearing member for bearing a toner image, a rotatable endless belt, a first driving member for rotationally driving the endless belt and in contact with an inner peripheral surface of the endless belt, and a second driving member for rotationally driving the endless belt and in contact with an outer peripheral surface of the endless belt. In addition, a tension detecting unit detects a state of tension of the endless belt and a controller controls a rotational speed of the second driving member. A driving force applied from the second driving member to the endless belt is smaller than a driving force applied from the first driving member to the endless belt, and the tension detecting unit includes a metal roller contacting the inner peripheral surface of the endless belt and detects the tension by movement of the metal roller which follows the endless belt. The controller controls, on the basis of a detection result of the tension detecting unit, the rotational speed of the second driving member so that the state of tension of the endless belt is a predetermined state.

10 Claims, 11 Drawing Sheets

(a)

(b)

(a)

(b)

(c)

(a)

(b)

(c)

IMAGE FORMING APPARATUS HAVING ENDLESS BELT TENSION DETECTION

FIELD OF THE INVENTION AND RELATED ART

The present invention relates to an image forming apparatus, such as a copying machine, a printer or a facsimile machine, for forming an image by an electrophotographic process or an electrostatic recording process.

In a conventional image forming apparatus toner images carried on an intermediary transfer belt (endless belt) are collectively transferred onto a sheet at a secondary transfer nip (secondary transfer portion) between the intermediary transfer belt and a secondary transfer surface. In order to stably convey the sheet at the secondary transfer portion, in some cases, the secondary transfer roller is connected to and rotated by a motor. In such cases, the intermediary transfer belt is stretched by a plurality of rollers containing a driving roller, so that the intermediary transfer belt receives a driving force for rotational movement from each of the driving roller and the secondary transfer roller.

In such a constitution, when a speed difference between a surface speed of the intermediary transfer belt at a portion where the intermediary transfer belt contacts the driving roller and a surface of the intermediary transfer belt at a portion where the intermediary transfer belt contacts the secondary transfer roller slightly occurs, a tension fluctuation of the intermediary transfer belt is generated. Further, the driving force applied from the secondary transfer roller to the intermediary transfer belt varies depending on the type of the sheet passing through the secondary transfer nip during image formation and an amount of a toner for an image. For this reason, when a speed fluctuation or tension fluctuation of the intermediary transfer belt is generated, toner images transferred from the respective image bearing members onto the intermediary transfer belt are deviated, so that image defect such as color misregistration is generated.

In order to solve this problem, in Japanese Laid-Open Patent Application (JP-A) 2007-164086, the secondary transfer roller contacting the intermediary transfer belt at a position different from the position of the driving roller is provided with a means, such as an encoder, for detecting a rotational speed. Then, on the basis of a detection value of this rotational speed detecting means, rotation control of the driving roller is effected. As a result, the speed difference of the intermediary transfer belt between the secondary transfer portion and the driving roller portion is minimized, so that the tension fluctuation of the intermediary transfer belt can be decreased.

Further, in JP-A 2008-145680, the tension of the intermediary transfer belt is detected by a tension applying member fixedly provided in an image forming apparatus in contact to the intermediary transfer belt. Then, on the basis of its detection result, a speed of the driving roller which controls the speed of the intermediary transfer belt and a speed of a member opposing the driving roller are controlled. As a result, the tension fluctuation of the intermediary transfer belt can be minimized.

However, in the constitution of JP-A 2007-164086, depending on the type of the sheet passing through the secondary transfer nip and the amount of the toner image, the driving force applied from the secondary transfer roller to the intermediary transfer belt with respect to a tangential direction changes in real time. The rotation control of the driving roller cannot follow this change, so that the speed fluctuation of the intermediary transfer belt occurs. As a result, the speed difference of the intermediary transfer belt is generated between the driving roller portion and the secondary transfer portion, thus leaving a problem that the tension of the intermediary transfer belt is fluctuated.

On the other hand, in the constitution of JP-A 2008-145680, by detecting the tension of the intermediary transfer belt, it is possible to follow the change in conveying force applied from the secondary transfer roller to the intermediary transfer belt. However, in order to stabilize the tension, the driving roller and the secondary transfer roller which control the rotational speed of the intermediary transfer belt are provided opposed to each other. For this reason, the intermediary transfer belt receives the driving force at one position with respect to the rotational direction thereof, so that the rotational speed and tension of the intermediary transfer belt are not constant over full circumference of the intermediary transfer belt. Further, the driving roller and the secondary transfer roller which increase and decrease the speed of the intermediary transfer belt are disposed downstream of a primary transfer portion with respect to a movement direction of the intermediary transfer belt. For this reason, a transfer portion is liable to be directly affected by the increase and decrease in speed of the driving roller and the secondary transfer roller during tension control.

SUMMARY OF THE INVENTION

A principal object of the present invention is to provide an image forming apparatus capable of suppressing a surface speed fluctuation and tension fluctuation of an endless belt over a full circumference to suppress an occurrence of an image defect.

According to an aspect of the present invention, there is provided an image forming apparatus comprising: an image bearing member for bearing a toner image; a rotatable endless belt; a first driving member for rotationally driving the endless belt in contact to an inner peripheral surface of the endless belt; a second driving member, provided at a position different from a position of the first driving member with respect to a rotational direction of the endless belt, for rotationally driving the endless belt in contact to an outer peripheral surface of the endless belt; a tension detecting unit for detecting a state of tension of the endless belt; and a controller for controlling a rotational speed of the second driving member, wherein a driving force applied from the second driving member to the endless belt is smaller than a driving force applied from the first driving member to the endless belt, and wherein the controller controls, on the basis of a detection result of the tension detecting unit, the rotational speed of the second driving member so that the state of tension of the endless belt is a predetermined state.

According to another aspect of the present invention, there is provided an image forming apparatus comprising: an image bearing member for bearing a toner image; a rotatable endless intermediary transfer belt onto which the toner image is to be primary-transferred from the image bearing member; a first driving source; a driving roller for stretching the intermediary transfer belt and for being rotationally driven by the first driving source; a second driving source; a secondary transfer roller, to be rotationally driven in contact to an outer peripheral surface of the intermediary transfer belt, for secondary-transferring the toner image from the intermediary transfer belt onto a recording material; a tension detecting unit for detecting a state of tension of the endless belt; and a controller for controlling a rotational speed of the secondary transfer roller, wherein the secondary transfer roller is provided at a position different from a position of the driving roller with respect to a rotational direction of the intermediary transfer belt, wherein a driving force applied from the secondary transfer roller to the intermediary transfer belt is smaller than a driving force applied from the driving roller to intermediary transfer belt, and wherein the controller controls, on the basis of a detection result of the tension detecting unit, the rotational speed of the second driving member so that the state of tension of the endless belt is a predetermined state.

These and other objects, features and advantages of the present invention will become more apparent upon a consideration of the following description of the preferred embodiments of the present invention taken in conjunction with the accompanying drawings.

Figure 2:
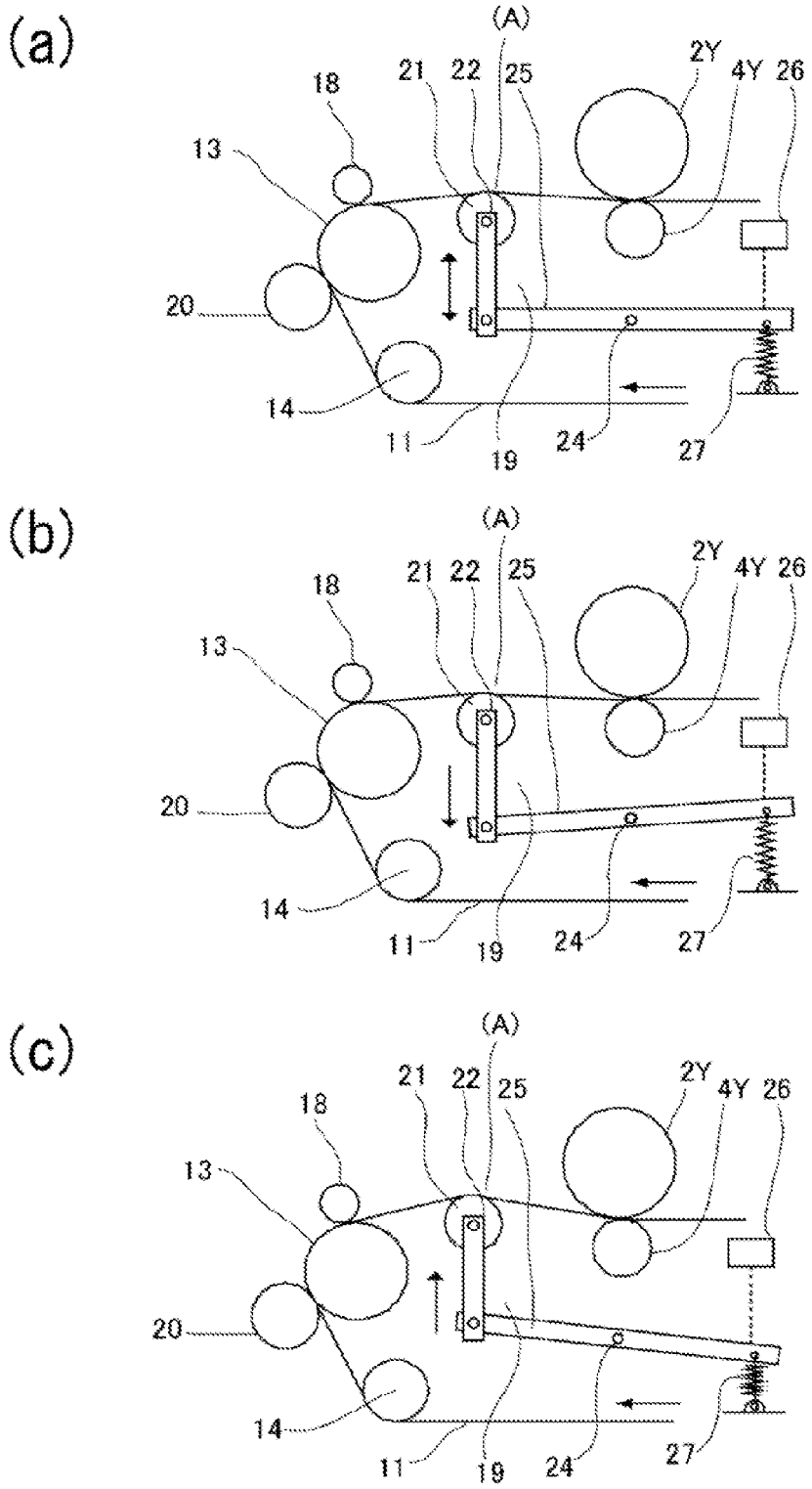

Parts (a) to (c) of FIG. 2 are schematic illustrates of a tension detecting unit in the First Embodiment.

Figure 3:
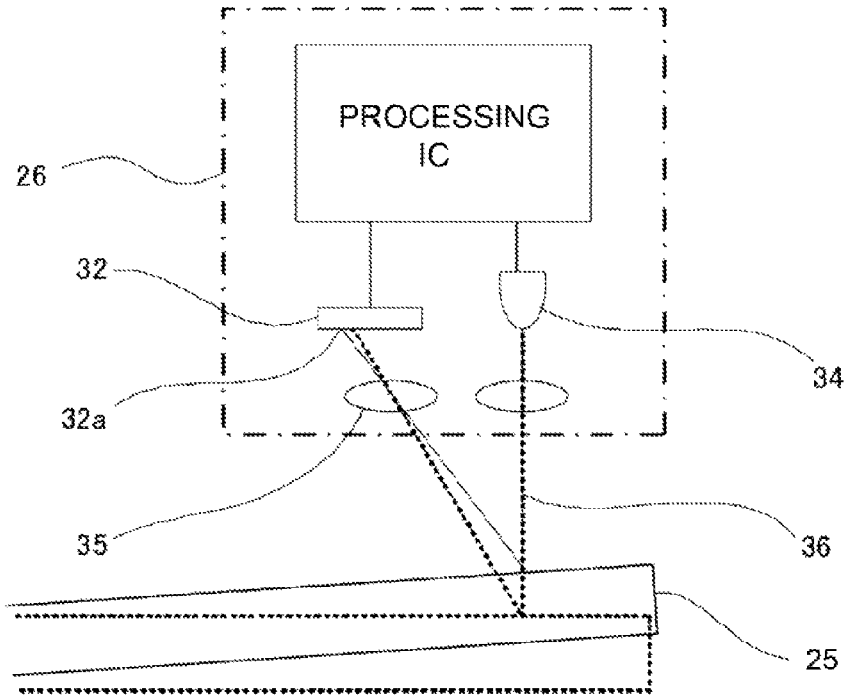
Figure 3:
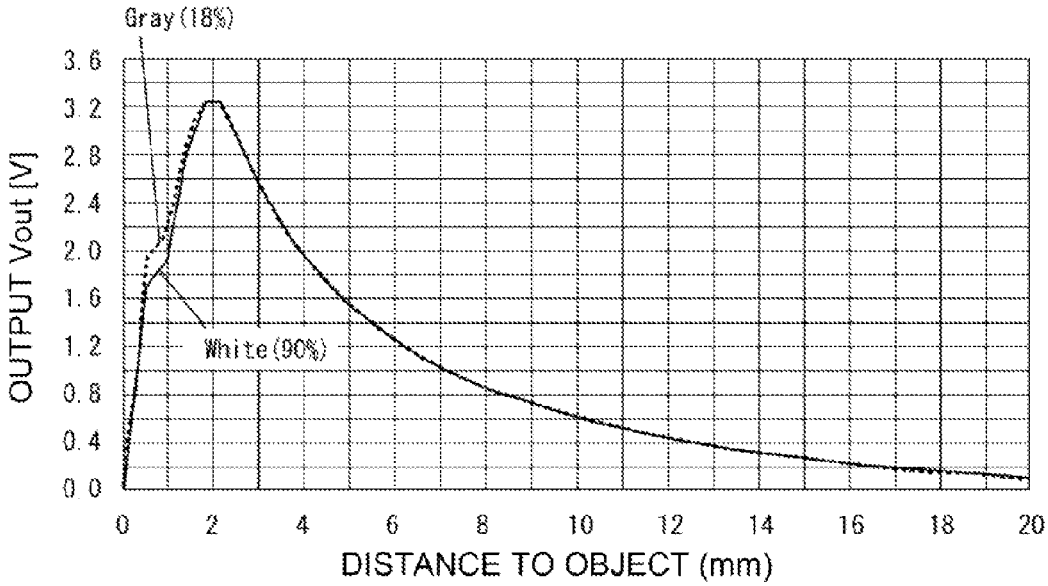

Part (a) of FIG. 3 is a schematic view of an optical distance measuring sensor in the First Embodiment, and (b) of FIG. 3 is a graph showing a relationship between an output voltage of the optical distance measuring sensor and a distance to an object to be detected.

Figure 4:
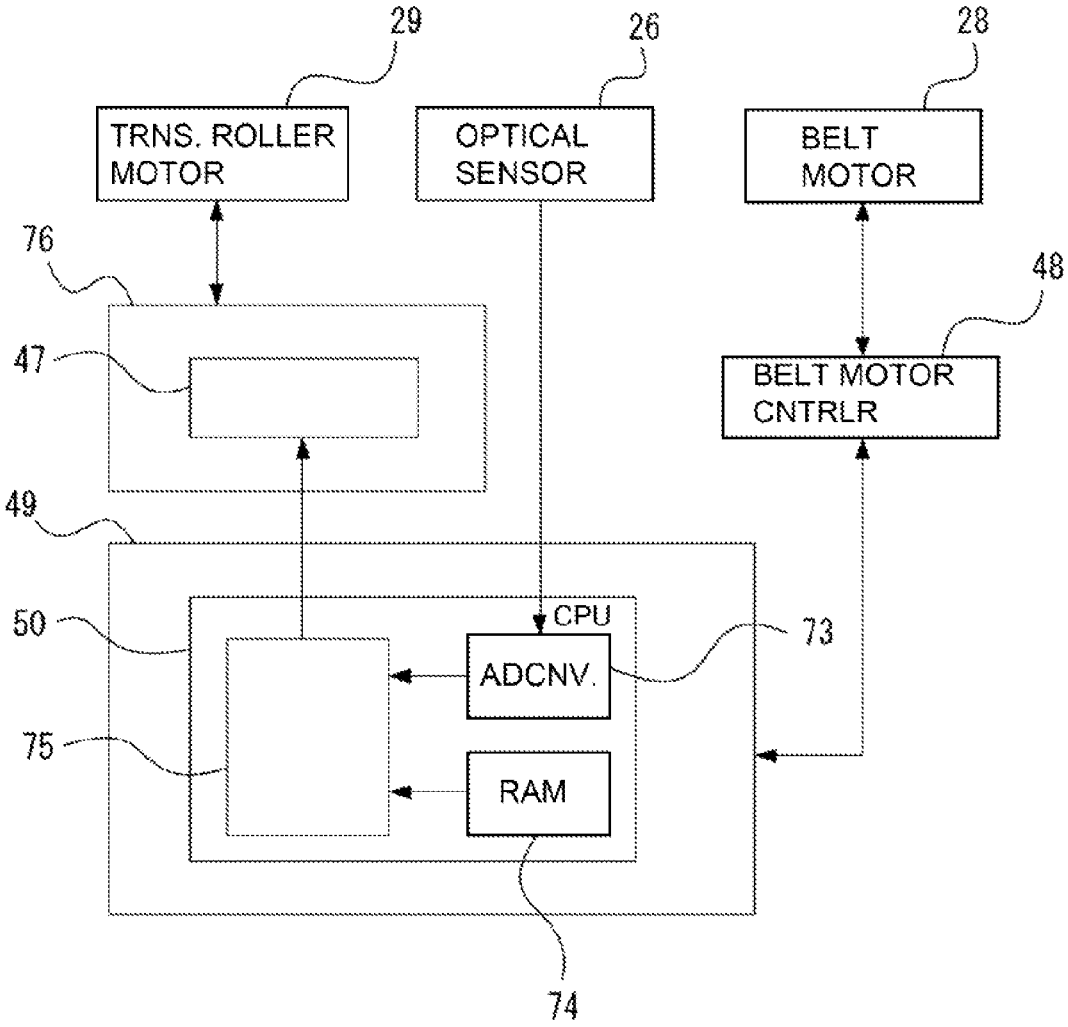

FIG. 4 is a block diagram of a control portion for controlling rotation of an intermediary transfer belt driving motor and a secondary transfer roller driving motor.

Figure 5:
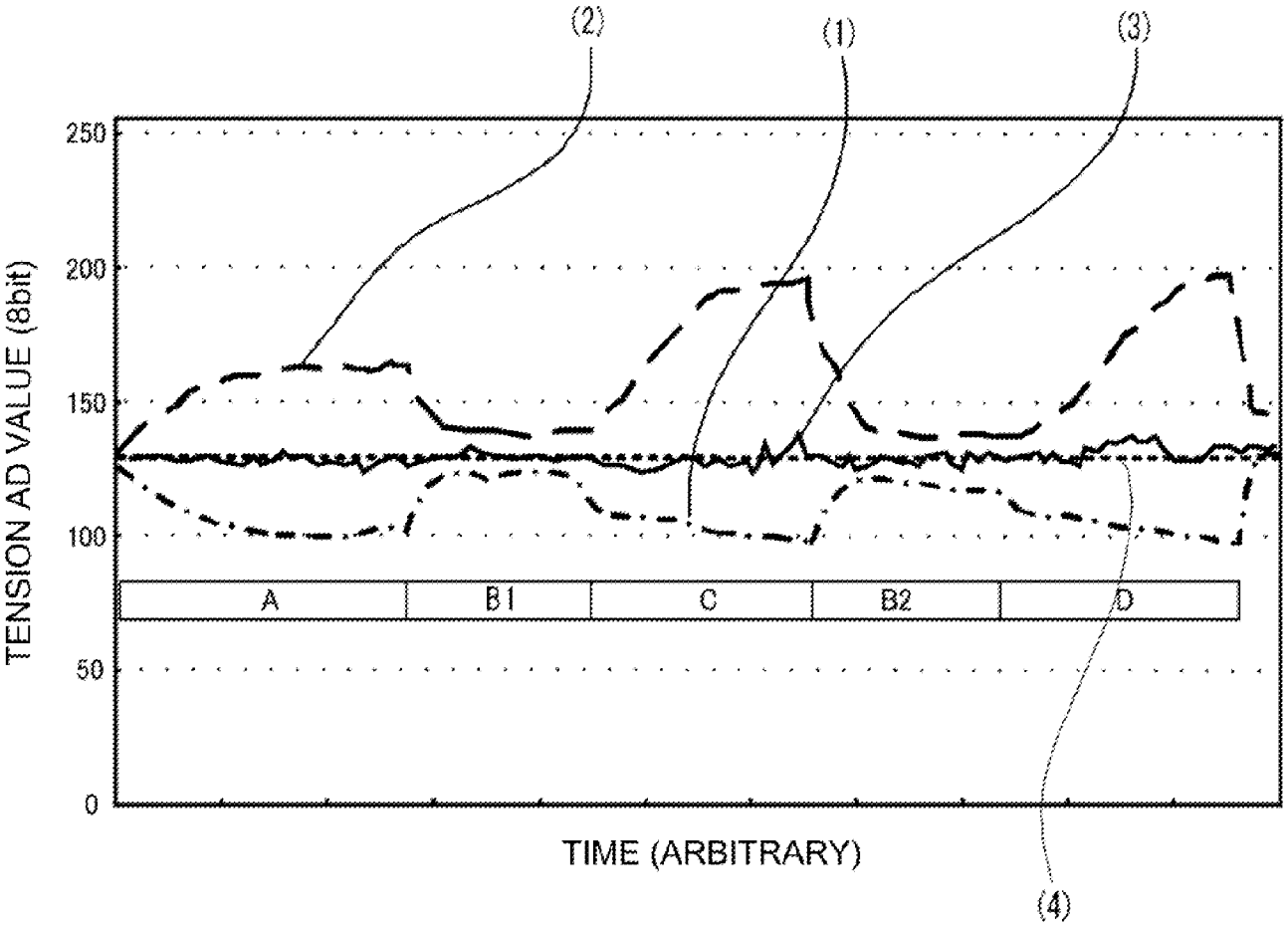

FIG. 5 is a graph showing a change of a tension AD value with time.

Figure 6:
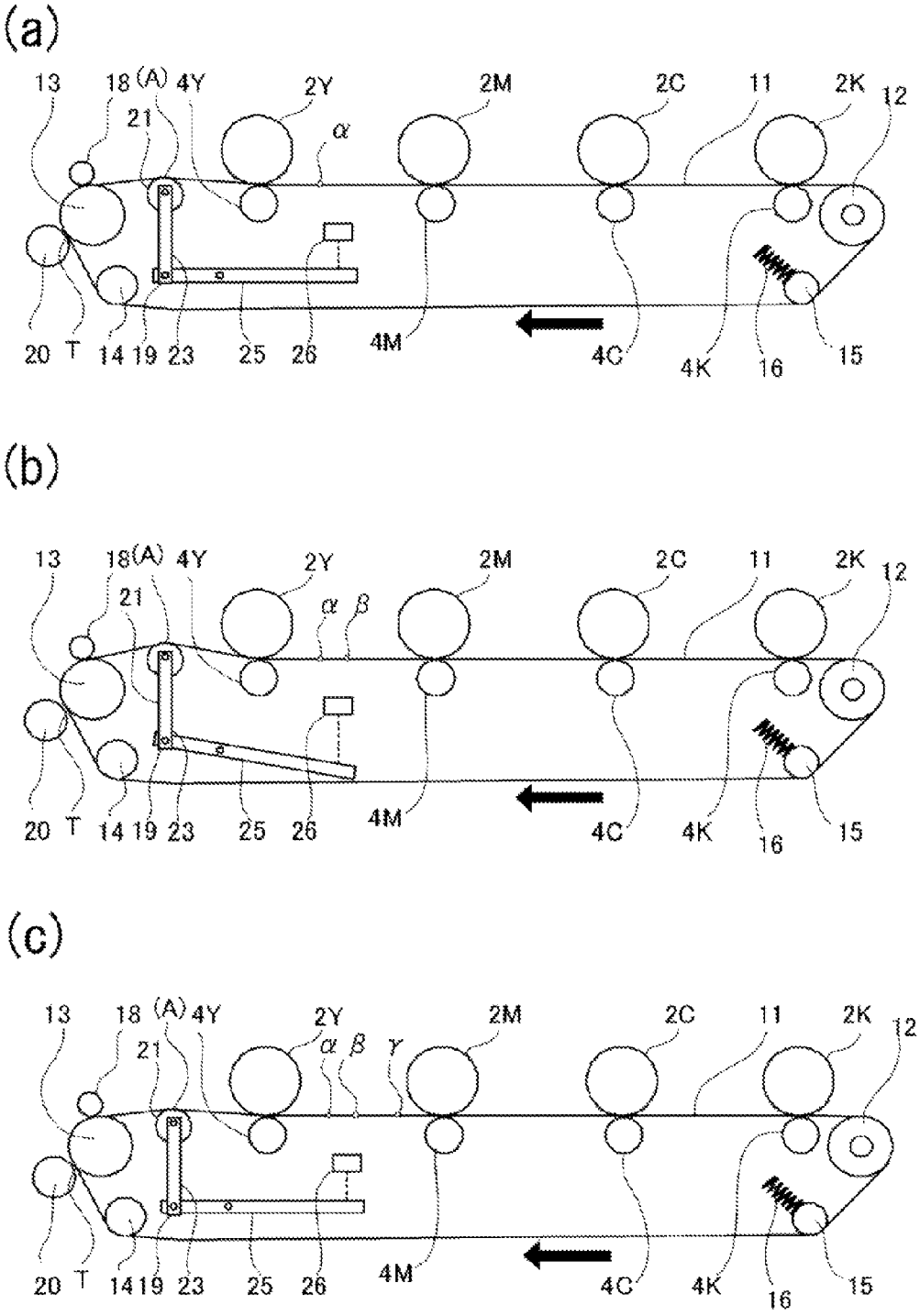

Parts (a) to (c) of FIG. 6 are schematic views showing a state of an intermediary transfer belt in a conventional image forming apparatus.

Figure 7:
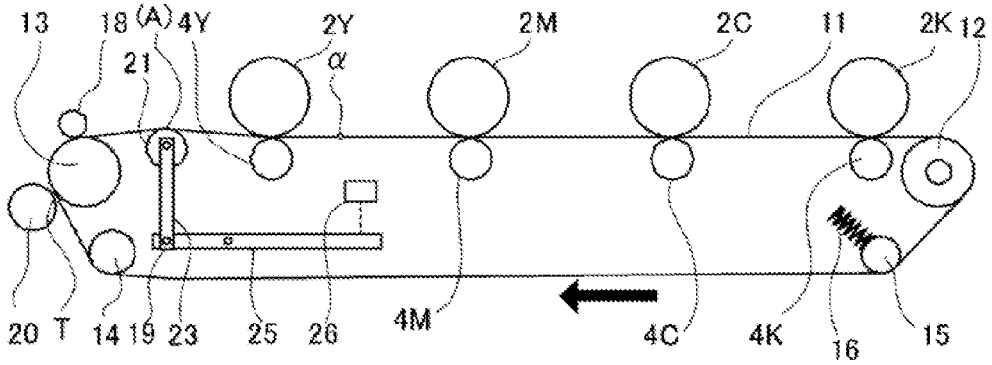
Figure 7:
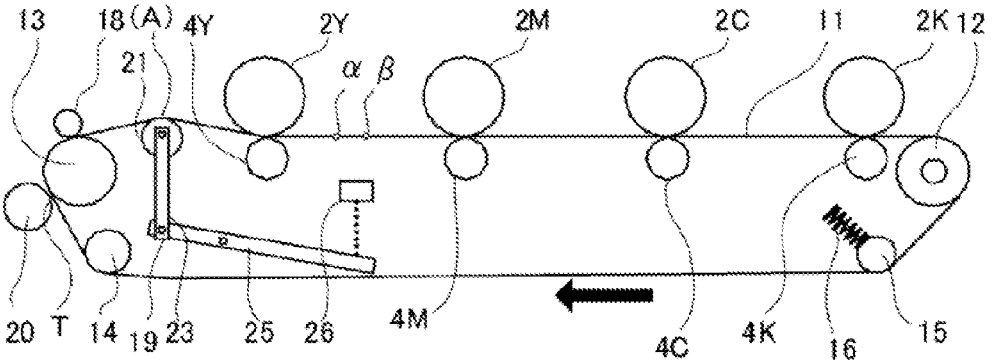
Figure 7:
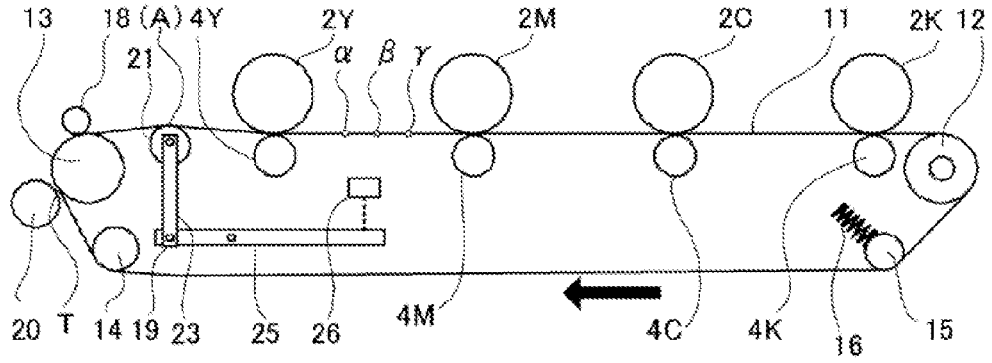

Parts (a) to (c) of FIG. 7 are schematic views showing a state of an intermediary transfer belt in the First Embodiment.

Figure 8:
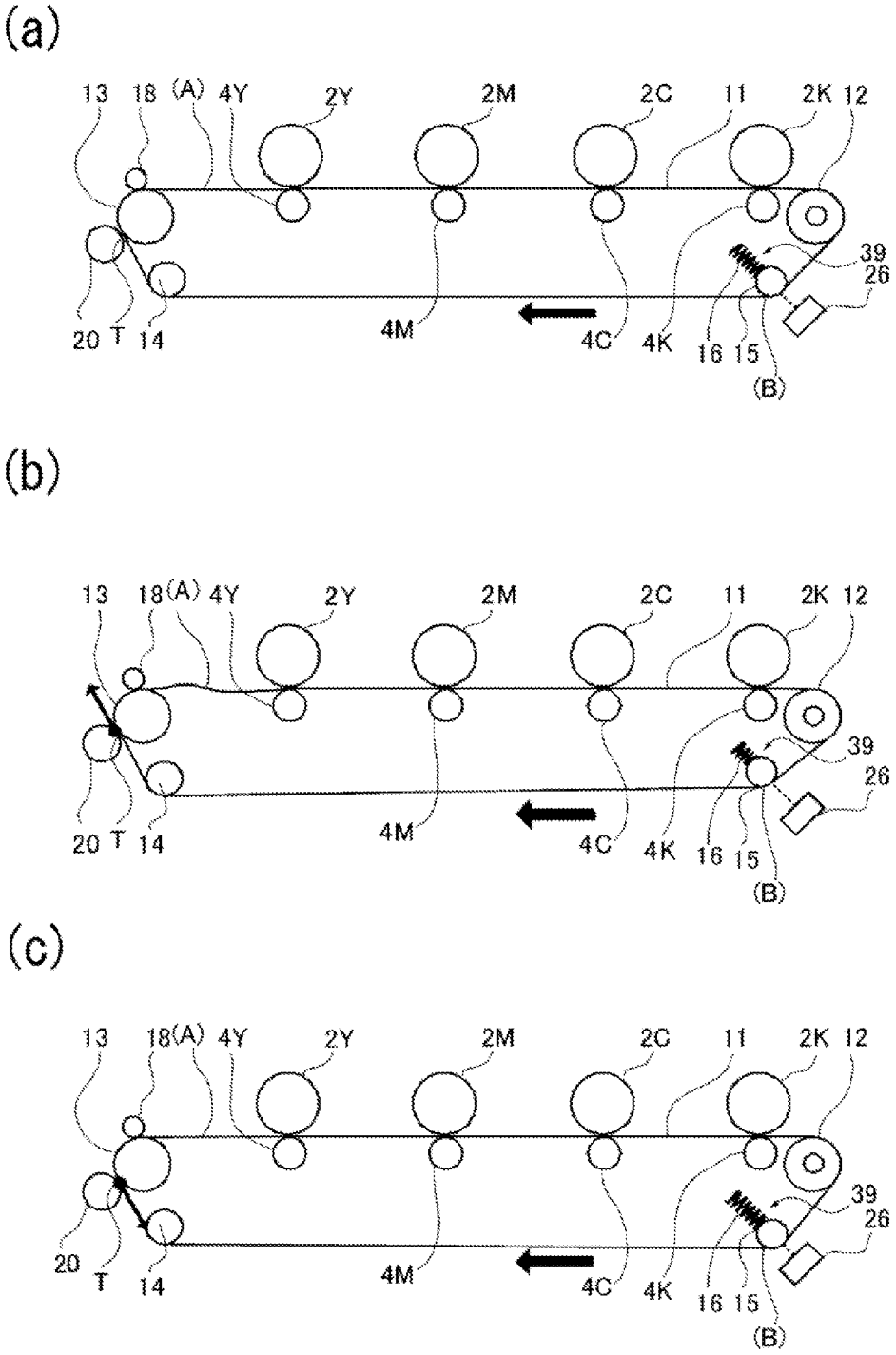

Parts (a) to (c) of FIG. 8 are schematic views showing a speed of an intermediary transfer belt in a Second Embodiment.

Figure 9:
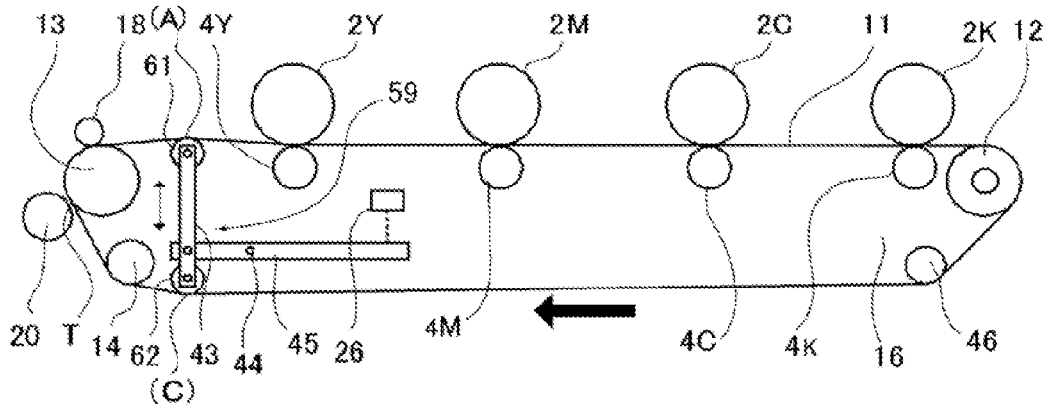
Figure 9:
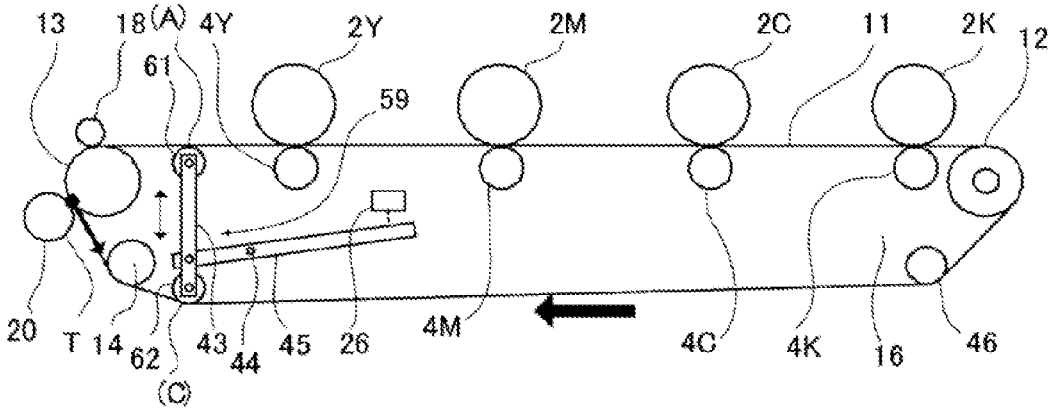
Figure 9:
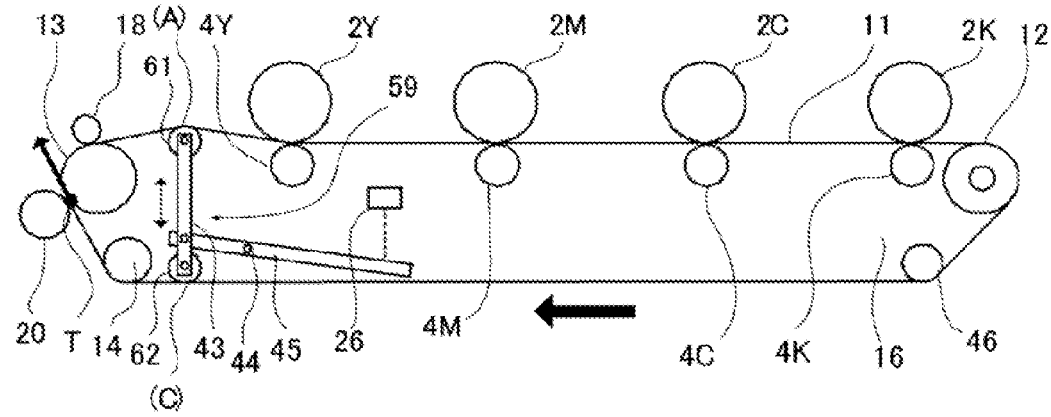

Parts (a) to (c) of FIG. 9 are schematic views showing a speed of an intermediary transfer belt in a Third Embodiment.

Figure 10:
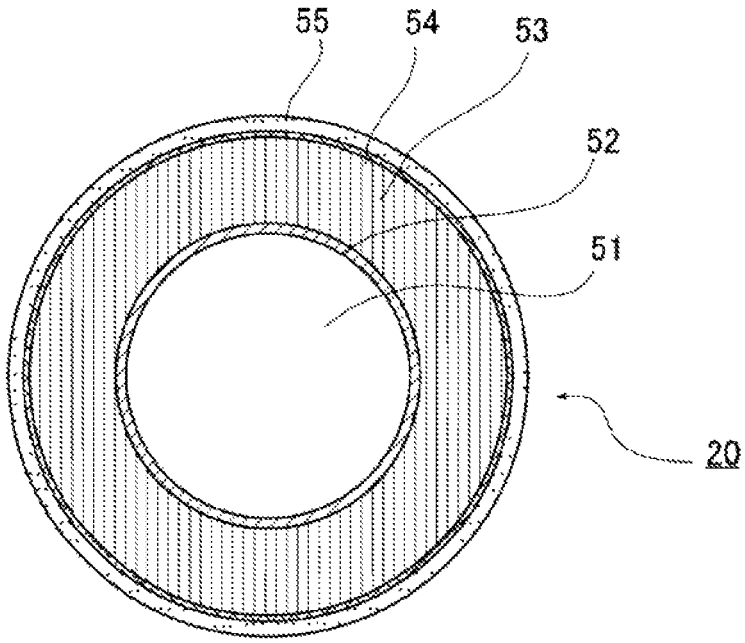

FIG. 10 is a sectional view of a secondary transfer roller in another constitution.

Figure 11:
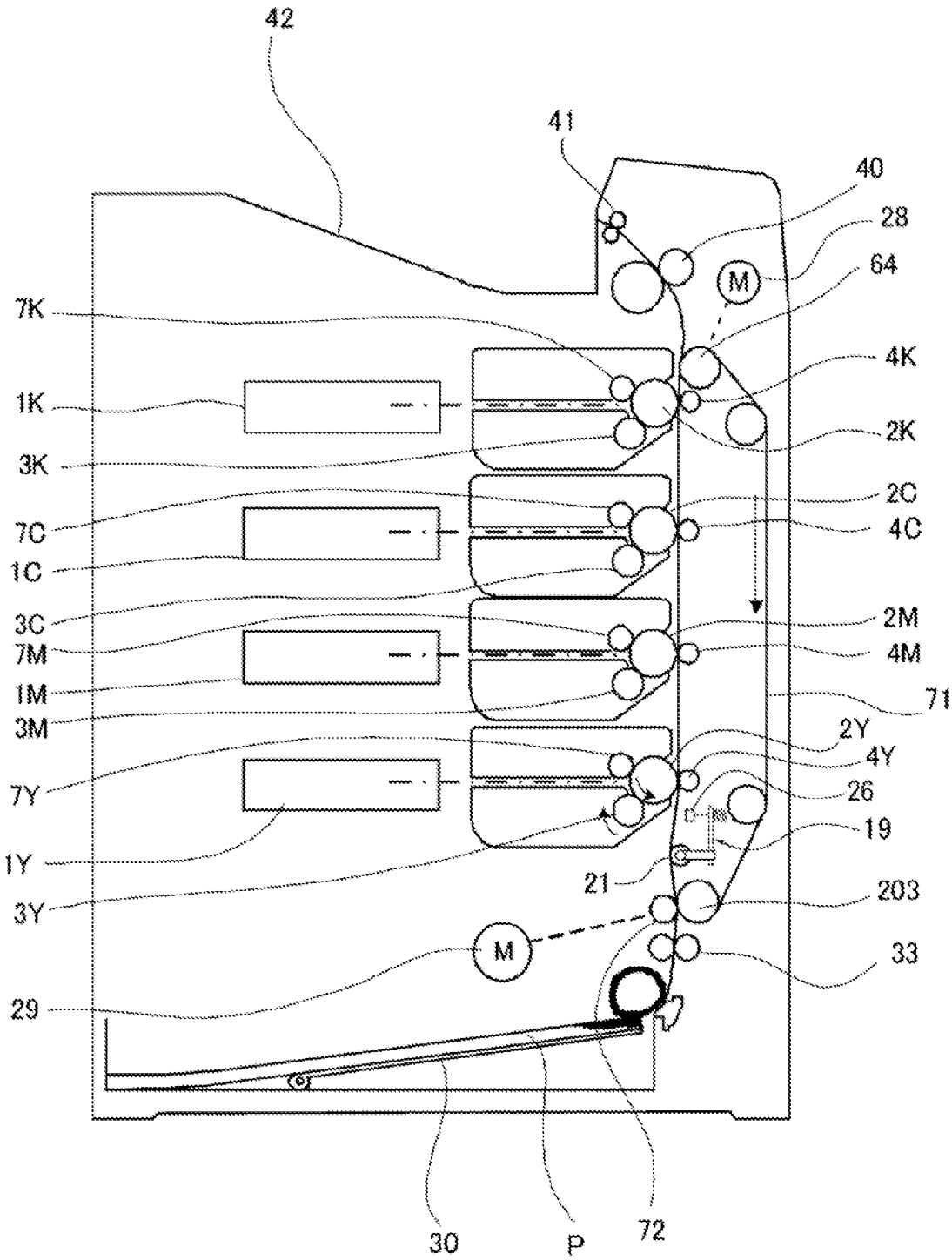

FIG. 11 is a schematic illustration of an image forming apparatus using a sheet conveying belt.

DESCRIPTION OF THE PREFERRED EMBODIMENTS

Hereinbelow, preferred embodiments of the present invention will be exemplarily and specifically described with reference to the drawings. However, dimensions, materials, shapes, relative arrangements and the like of constituent elements described in the following embodiments are appropriately changed depending on constitutions or various conditions of apparatuses to which the present invention is applied. Therefore, the scope of the present invention is not limited thereto unless otherwise specified.

First Embodiment

Figure 1:
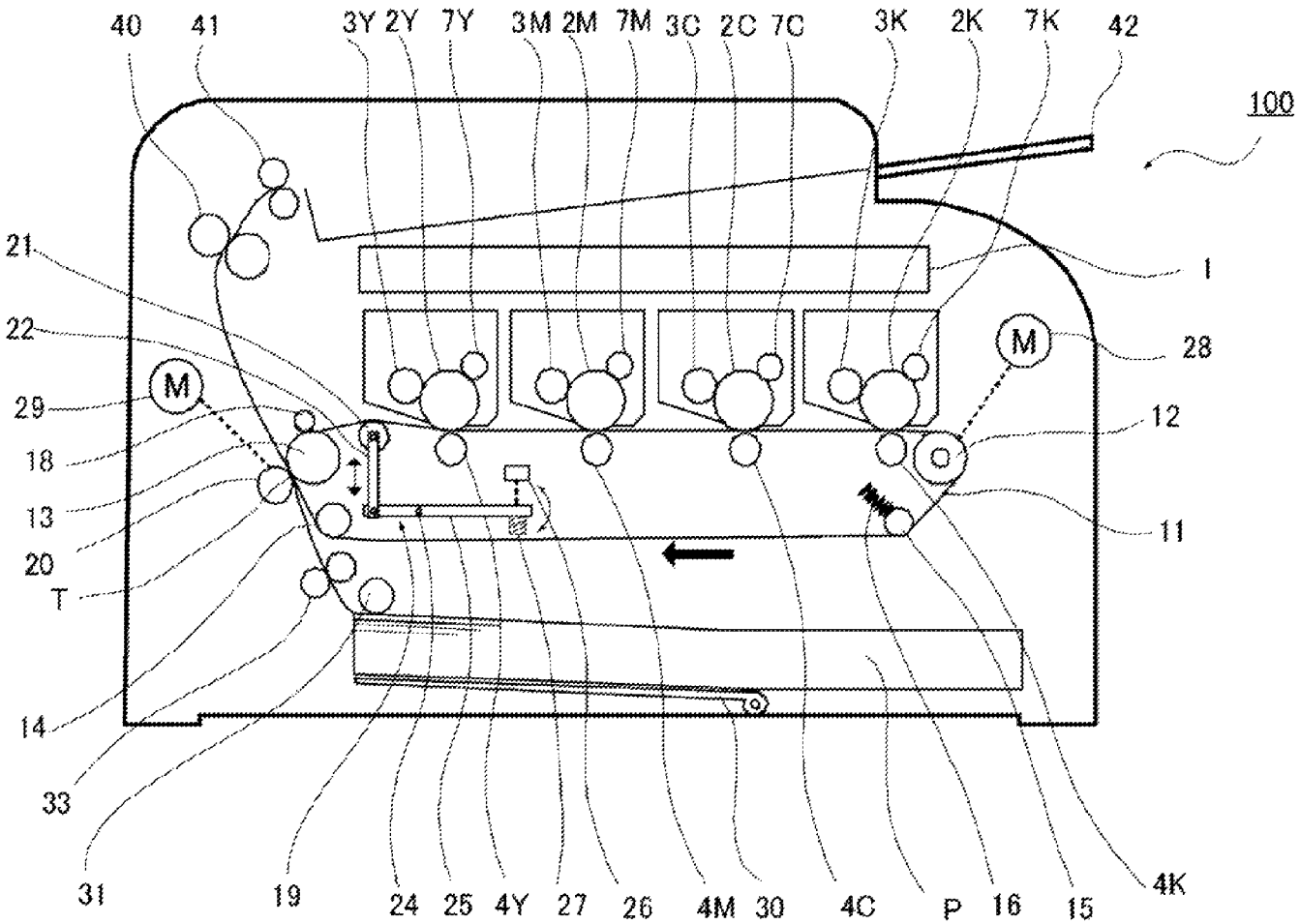
FIG. 1 is a schematic illustration of an image forming apparatus in the First Embodiment.

An image forming apparatus according to the First Embodiment of the present invention will be described with reference to the drawings. FIG. 1 is a schematic illustration of the image forming apparatus in this embodiment. As shown in FIG. 1, in an image forming apparatus 100 in this embodiment, surfaces of photosensitive drums (image bearing members) 2Y, 2M, 2C and 2K for yellow, magenta, cyan and black, respectively are electrically charged uniformly by primary charges 7Y, 7M, 7C and 7K, respectively. The charged photosensitive drums 2Y to 2K are exposed to light depending on image information by an exposure device 1, so that electrostatic latent images are formed. The electrostatic latent images are developed with color toners into color toner images by developing devices 3Y to 3K. The respective color toner images are successively primary-transferred superposedly onto a rotatable intermediary transfer belt (endless belt) 11 by primary transfer rollers (transfer devices) 4Y to 4K. The intermediary transfer belt 11 receives a driving force from an intermediary transfer belt driving roller (first driving member) for stretching an inner peripheral surface of the intermediary transfer belt 11, thus being rotated.

On the other hand, a sheet P in a cassette 30 is conveyed to a secondary transfer nip by a feeding roller 31 and a registration roller pair 33, and the four color toner images are secondary-transferred onto the sheet P. The secondary transfer nip T is formed between a secondary transfer roller (second driving member) 20 and the intermediary transfer belt 11 supported by a secondary transfer opposite roller 13. The sheet P on which the toner images are transferred is heated and pressed by a fixing device 40 to fix thereon the toner images and then is discharged onto a discharge tray 42 by a discharging roller pair 41. A transfer residual toner remaining on the intermediary transfer belt 11 after the secondary transfer is removed by an intermediary transfer belt cleaning roller 18.

The intermediary transfer belt 11 is stretched by the intermediary transfer belt driving roller (first driving member) 12, the secondary transfer opposite roller 13, a tension roller 15 and a follower roller 14. Therefore, the intermediary transfer belt driving roller 12 drives the intermediary transfer belt 11 in contact to an inner peripheral surface of the intermediary transfer belt 11, and the secondary transfer roller 20 drives the intermediary transfer belt 11 in contact to an outer peripheral surface of the intermediary transfer belt 11. The intermediary transfer belt driving roller 12 is rotationally driven by an intermediary transfer belt driving motor 28 as a first driving source. The tension roller 15 is urged by a tension spring 16 to apply predetermined tension to the intermediary transfer belt 11. The secondary transfer roller 20 is rotationally driven by a secondary transfer roller driving motor 29 as a second driving source.

(Constitution for Suppressing Tension Fluctuation and Speed Fluctuation of Intermediary Transfer Belt 11)

In the image forming apparatus 100 in this embodiment, the intermediary transfer belt driving roller 12 is provided downstream of the primary transfer portion as a primary transfer nip between the photosensitive drum 2 and the intermediary transfer belt 11 contacted to the primary transfer roller 4, and the secondary transfer roller 20 is provided upstream of the primary transfer portion. The intermediary transfer belt driving roller 12 is larger in driving force, as a force for rotating the intermediary transfer belt 11, than the secondary transfer roller 20. For this reason, the intermediary transfer belt driving roller 12 predominantly controls the rotational speed of the intermediary transfer belt 11.

Here, depending on the presence or absence of the toner or the sheet at the secondary transfer portion as the secondary transfer nip between the secondary transfer roller 20 and the intermediary transfer belt 11 supported by the secondary transfer opposite roller 13, the driving force applied from the secondary transfer roller 20 to the intermediary transfer belt 11 is changed. As a result, there is a possibility of an occurrence of the speed fluctuation of the intermediary transfer belt 11.

Therefore, in this embodiment, a state of tension of the intermediary transfer belt 11 at a position between the primary transfer portion and the secondary transfer portion which are liable to be influenced by the change in the above-described conveying force (driving force) is detected by a tension detecting unit 19 and on the basis of a detection result, the rotational speed of the secondary transfer roller 20 is controlled. As a result, the tension fluctuation and speed fluctuation of the intermediary transfer belt 11 are suppressed.

A constitution for suppressing the tension fluctuation and speed fluctuation of the intermediary transfer belt 11 will be described specifically.

(Tension Detecting Unit)

Parts (a) to (c) of FIG. 2 are illustrations of the tension detecting unit 19 for the intermediary transfer belt 11. As shown in (a) of FIG. 2, the tension detecting unit 19 for the intermediary transfer belt 11 includes a tension detecting roller 21, a connecting member 22, a tension detecting member 25, an optical distance measuring sensor (detecting device) 26 and a tension spring 27. The tension detecting roller 21 and the connecting member 22 constitute a movable device.

The tension detecting roller 21 is a metal roller and is contacted to the inner peripheral surface of the intermediary transfer belt 11 at a position between the secondary transfer opposite roller 13 and the photosensitive drum 2Y ((A) in FIG. 2). The tension detecting roller 21 is urged against the inner peripheral surface of the intermediary transfer belt 11 by an urging force of the tension spring 27 via the connecting member 22 and the tension detecting member 25.

The tension detecting roller 21 presses down one end portion of the tension detecting member 25 via the connecting member 22 depending on the state of tension of the intermediary transfer belt 11. The tension spring 27 urges the other end of the tension detecting member 25. The tension detecting member 25 is, depending on the balance between the tension state (tension) of the intermediary transfer belt 11 and the urging force of the tension spring 27, rotationally moved about a central rotation center 24 like a see-saw, so that the tension state and the urging force are balanced at a predetermined position.

In this embodiment, a lever ratio between the tension spring 27 and the connecting member 22 was determined in view of the weight of the tension detecting roller 21 or the like so that the tension detecting roller 21 presses the inner peripheral surface (back surface) of the intermediary transfer belt 11 of 240 mm in width with a force of about 5N during a stop of the image forming apparatus 100.

The optical distance measuring sensor 26 is a distance measuring sensor of an infrared type and detects a position of the tension detecting member 25. As shown in (a) of FIG. 3, the optical distance measuring sensor 26 includes an LED (light emitting portion) 34 and a PSD (position sensitive device or position detecting element) 32.

The light emitting portion 34 emits infrared ray 36 toward the other end portion (objected to be subjected to distance measurement) of the tension detecting member 25. Reflected light diffused and reflected by the object to be subjected to distance measurement is focused by a focusing means 35 for light receiving provided in front of a light receiving surface 32*a* of the PSD 32, thus being guided to the light receiving surface 32*a*. Based on a position of a center of distribution of the infrared ray which reaches the light receiving surface 32*a*, a distance to the measurement object is calculated by the triangulation. In this method, the position of the distribution center of the infrared ray which reaches the light receiving surface 32*a* is converted into the distance and therefore even when a reflectance is changed depending on a surface state of the measurement object, the change does not influence a distance data.

Further, the position detected by the light receiving portion 32 is converted into the distance by an processing IC and then the converted distance is outputted as a voltage value. Part (b) of FIG. 3 is a graph showing a relationship between the detected distance and the outputted voltage value (Vout). In this embodiment, the optical distance measuring sensor 26 was disposed so that the distance from the sensor 26 to the tension detecting member 25 as the measurement object (to be detected) ranges from 4 mm to 10 mm.

Here, with reference to (a) to (c) of FIG. 2, depending on a change in tension state (tension) of the intermediary transfer belt 11, how to operate the tension detecting unit 19 will be described. Part (a) of FIG. 2 shows that the tension state is a neutral state. The neutral state refers to a state in which the tension is substantially the same over the full circumference of the intermediary transfer belt 11.

Part (b) of FIG. 2 shows a state in which the tension between the secondary transfer opposite roller 13 and the photosensitive drum 2Y ((A) in (b) of FIG. 2) is increased. The tension detecting roller 21 is changed in position of the balance with the tension spring 27 with the increase in tension at the portion (A) on the intermediary transfer belt 11, thus being moved downward as shown in (b) of FIG. 2. Depending on motion of the tension detecting roller 21, the connecting member 22 and the tension detecting member 25 are moved, so that the distance between the optical distance measuring sensor 26 and the other end portion of the tension detecting member 25 is shorter than that in the neutral state.

Part (c) of FIG. 2 shows a state in which the tension at the portion (A) in (c) of FIG. 2 is decreased. The tension detecting roller 21 is changed in position of the balance with the tension spring 27 when the tension at the portion (A) is lowered, thus being moved upward as shown in (c) of FIG. 2. As a result, the distance between the optical distance measuring sensor 26 and the other end portion of the tension detecting member 25 is longer than that in the neutral state.

Thus, from the distance measured by the optical distance measuring sensor 26, it becomes possible to detect the tension of the intermediary transfer belt 11. Incidentally, in this embodiment, the part linked to the tension detecting roller 21 is provided and the position thereof is detected by the optical distance measuring sensor 26 but the position of the tension detecting roller 21 may also be directly detected by the optical distance measuring sensor 26.

(Controller for Intermediary Transfer Belt Driving Motor 28 and Secondary Transfer Roller Driving Motor 29)

FIG. 4 is a block diagram of a control portion for controlling rotation of the intermediary transfer belt driving motor 28 and the secondary transfer roller driving motor 29. As shown in FIG. 4, the output voltage value of the optical distance measuring sensor 26 obtained depending on the tension of the intermediary transfer belt 11 is converted by an AD converter 73 of a CPU 50 provided in a controller 49 in the image forming apparatus 100, so that a tension AD value depending on the distance is obtained.

RAM 72 in a CPU 42 stores a target tension AD value as a control target. A secondary transfer driving roller motor rotation number determining portion 75 determines the rotation number of the motor 29 by using the target tension AD value stored in the RAM 74 and the tension AD value of the intermediary transfer belt 11 sent to the CPU 42. Information on the determined motor rotation number is sent to a secondary transfer roller driving motor rotation number setting portion 47 in a secondary transfer roller driving motor controller 76 and then on the basis of the set rotation number, the controller 76 controls the secondary transfer roller driving motor 29 to rotationally drive the secondary transfer roller 20.

The controller 49 and the secondary transfer roller motor controller 76 constitute the control portion for controlling, on the basis of a detection result of the tension detecting unit 19, the speed of the secondary transfer roller 20 so that the speed fluctuation of the intermediary transfer belt 11 is suppressed.

In this embodiment, the control is effected by using PI control of the motor rotation number so that the tension AD value during an operation converges to the target tension AD value. A proportional gain for P (proportional) control was determined in a range in which the tension AD value does not cause overshooting and bunting with respect to the target tension AD value. This is because when the overshooting and hunting are generated, the tension fluctuation is generated and thus color misregistration or the like is caused. Further, with respect to deviation (offset) from the target AD value such that the tension AD value is left without reaching the target tension AD value only by the proportional control, an integral control parameter was determined so as to remove the deviation by I (integral) control. By adding the integral control, an output change is continued so long as the offset occurs and therefore the offset is gradually attenuated, so that the tension AD value converges to the target tension AD value.

On the other hand, the intermediary transfer belt driving motor 28 which dominantly controls the speed of the intermediary transfer belt 11 is constituted by a DC brush-less motor and is drive-controlled by the intermediary transfer belt driving motor controller 48. The intermediary transfer belt driving motor controller 48 controls the intermediary transfer belt driving motor 28 by receiving a rotational state signal from the driving motor 28 so that the rotation number suitable for the image formation is provided.

(Color Misregistration and Transfer Deviation)

The color misregistration is known and will be omitted from detailed description. The color misregistration is an image defect generated by misregistration of the toner images of Y (yellow), M (magenta), C (cyan) and K (black). The color misregistration remedied by the present invention is caused by the speed fluctuation of the intermediary transfer belt 11 with respect to the rotational direction (movement direction) of the intermediary transfer belt 11.

For this reason, an effect of the present invention was evaluated in terms of the color misregistration with respect to the movement direction (sub-scan direction) of the intermediary transfer belt 11. In general, the color misregistration is easily recognizable when a size thereof is 150 μm or more and therefore it is desirable that the color misregistration is 100 μm or less in size. It is further desirable that the color misregistration is 50 μm or less in size. As a result, blur of a character due to the color misregistration and color shift of a process color (mixed color of two or more colors) are not conspicuous.

The transfer deviation remedied by the present invention is caused by instantaneous speed fluctuation or tension fluctuation of the intermediary transfer belt 11. An occurrence mechanism thereof will be described below. When a speed difference between the secondary transfer roller 20 and the intermediary transfer belt 11 is generated even in a slight degree during post-rotation or sheet interval (state between the current sheet and a subsequent sheet) in which the sheet and the toner are not present in the secondary transfer nip, the intermediary transfer belt 11 receives a large driving force from the secondary transfer roller 20. As a result, on the intermediary transfer belt 11, a tension-relieved state and a tension(-applied) state can be generated. This is conspicuous in the case where a friction coefficience between the secondary transfer roller 20 and the intermediary transfer belt 11 is large.

On the other hand, when the sheet and the toner are present in the secondary transfer nip (portion), a sliding (lubricating) effect is generated in the secondary transfer nip, so that the tangential force applied from the secondary transfer roller 20 to the intermediary transfer belt 11 becomes small. For this reason, at the instant when the sheet and the toner enter the secondary transfer nip T, the instantaneous tension fluctuation or speed fluctuation is generated on the intermediary transfer belt 11. This tension fluctuation or speed fluctuation is transmitted to the primary transfer portion to cause deviation or slippage, so that the image is blurred. This phenomenon is referred to as the transfer deviation.

(Suppressing Effect of Tension Fluctuation of Intermediary Transfer Belt 11)

FIG. 5 is a graph showing a change of the tension AD value with time when printing of a 50%-black halftone image on 2 pages (sheets) in total was effected in an 1-page intermittent manner. In the 1-page intermittent manner, a print job is executed by effecting the printing on one sheet and then by providing a rest period.

In FIG. 5, the ordinate represents the tension AD value which is AD-converted into 8-bit digital value and shows 256 as a maximum in terms of a decimal value (decimal number). A smaller value of the ordinate means that the tension of the intermediary transfer belt 11 at a tension detection position ((A) in FIG. 2) is in a low-tension state (tension-relieved state). A larger value of the ordinate means that the tension at the tension detection position is in a high-tension state (tension(-applied) state). In FIG. 5, A, B1, B2, C and D represent an apparatus state during the image formation. Specifically, A represents pre-rotation, B1 and B2 represent during the secondary transfer (where the sheet is present in the secondary transfer nip), C represents a sheet interval, and D represents post-rotation.

In FIG. 5, line (1) shows a change of the tension AD value with time in a conventional image forming apparatus. In the conventional image forming apparatus, a tension detection result of the intermediary transfer belt 11 is not fed back to the rotational drive control of the motor 29.

The line (1) in FIG. 5 shows the case where the conveyance speed of the intermediary transfer belt 11 by the motor 29 (secondary transfer roller 20) is higher than the conveyance speed of the intermediary transfer belt 11 by the motor 28 (intermediary transfer belt driving roller 12). In this case, during the pre-rotation (A in FIG. 5), the tension at the tension detection position ((A) in FIG. 2) is relieved, i.e., the value of the ordinate is decreased. Then, with timing (start point of B1 in FIG. 5) when the sheet enters the secondary transfer portion, the relieved tension state of the intermediary transfer belt 11 is eliminated, so that the sheet is carried and held on the intermediary transfer belt 11 until it completely passes through the secondary transfer portion (end point of B1 in FIG. 5). During the sheet interval (C in FIG. 5), the tension of the intermediary transfer belt 11 is relieved and then the tension-relieved state is eliminated during the transfer of the toner image on the second page (B2 in FIG. 5). During the post-rotation (D in FIG. 5), the tension is relived, so that the print job is ended.

Line (2) in FIG. 5 shows the case where the conveyance speed of the intermediary transfer belt 11 by the motor 29 (secondary transfer roller 20) is lower than the conveyance speed of the intermediary transfer belt 11 by the motor 28 (intermediary transfer belt driving roller 12). In this case, when the sheet is not present in the secondary transfer nip (A, C and D in FIG. 5), the tension of the intermediary transfer belt 11 is in the tension(-applied) state (high-tension state).

As described above, in the case where the secondary transfer roller 20 is rotationally driven, when the speed difference is generated between the conveyance speed of the intermediary transfer belt 11 by the motor 29 and the conveyance speed of the intermediary transfer belt 11 by the motor 28, the tension fluctuation is generated depending on the image forming process. When the tension fluctuation is generated, the tension fluctuation is transmitted to the primary transfer portion, so that a possibility that the image defect such as the color misregistration or an image deviation is generated is increased.

Line (3) in FIG. 5 shows a change of the tension AD value with time in the image forming apparatus in this embodiment. In the image forming apparatus in this embodiment, the rotational speed control of the secondary transfer roller driving motor 29 (secondary transfer roller 20) is effected. As a result, the tension AD value detected by the tension detecting unit 19 is controlled so as to converge to the target tension AD value stored in advance in RAM 74 of the controller 49. In this embodiment, the target tension AD value is set at 130 (decimal value).

As shown by the line (3) in FIG. 5, the tension AD value of the intermediary transfer belt 11 converges to the target tension AD value (line (4) in FIG. 5) at an initial stage of the pre-rotation (A) and is constant throughout the image formation. Thus, according to this embodiment, over the entire image formation, the tension fluctuation can be suppressed. That is, the control portion controls, on the basis of the detection result of the tension detecting unit 19, the rotational speed of the secondary transfer roller 20 so that the tension state of the intermediary transfer belt is a predetermined state, thus suppressing the tension fluctuation throughout the image formation.

The print job of 2 pages in 1-page intermittent manner was executed 10 times, thus forming the image on 20 sheets in total in each of the conventional image forming apparatus and the image forming apparatus in this embodiment. With respect to occurrence probability of the transfer deviation and the color misregistration with respect to the sub-scan direction, comparison between the conventional image forming apparatus and the image forming apparatus in this embodiment was made. In the case where the conventional image forming apparatus was used (in the cases of the lines (1) and (2) in FIG. 5), the occurrence probability of the transfer deviation was about 10%. Further, a worst value of the color misregistration was 120 μm and an average of the color misregistration was 80 μm. On the other hand, in the case of the image forming apparatus in this embodiment (the case of the line (3) in FIG. 5), there was no occurrence of the transfer deviation. Further, the worst value of the color misregistration was 80 μm and the average of the color misregistration was 60 μm.

(Suppressing Effect of Speed Fluctuation of Intermediary Transfer Belt 11)

Parts (a) to (c) of FIG. 6 are schematic views each showing a surface speed state of the intermediary transfer belt 11 in the case where the tension fluctuation of the intermediary transfer belt 11 generated due to a tangential force fluctuation of the secondary transfer nip T is controlled so as to be intended to be made constant by using the conventional image forming apparatus.

Part (a) of FIG. 6 shows a state of the intermediary transfer belt 11 when the state of the intermediary transfer belt 11 at the portion (A) in the figure is a target tension state (predetermined tension state). Here, a belt position of the intermediary transfer belt 11 in the neighborhood of the primary transfer portion (a position downstream of the photosensitive drum 2Y) is taken as "a".

Part (b) of FIG. 6 shows a state after a lapse of a time t from the state of (a) of FIG. 6. During the lapse of the time t, the fluctuation of the tangential force is generated in the secondary transfer nip T, so that the tension of the intermediary transfer belt 11 at the portion (A) is relieved. During this period, the intermediary transfer belt driving roller 12 is rotated in a steady state, so that the position "α" in (a) of FIG. 6 is moved to a position "β" in (b) of FIG. 6.

Part (c) of FIG. 6 shows a state, after a lapse of time t from the state of (b) of FIG. 6, in which the tension at the portion (A) is changed to the target tension (state of (a) of FIG. 6) by using the conventional image forming apparatus. In the conventional image forming apparatus, in the case where the tension-relieved state of the intermediary transfer belt 11 at the portion (A) is detected, in order to eliminate the tension-relieved state, the speed of the intermediary transfer belt driving roller 12 is increased. Therefore, the position "β" in (b) of FIG. 6 is moved to a position "γ" in (c) of FIG. 6.

As is understood from (a) to (c) of FIG. 6, a movement speed (Vαβ) of the intermediary transfer belt 11 at the primary transfer portion in a section from the position "α" in (a) of FIG. 6 to the position β in (b) of FIG. 6 is lower than a movement speed (Vβγ) of the intermediary transfer belt 11 in a section from the position β in (b) of FIG. 6 to the position γ in (c) of FIG. 6. That is, in the conventional image forming apparatus, correction of the tension of the intermediary transfer belt is made by effecting control by using the drive of the intermediary transfer belt driving roller 12 which provides a larger conveying force than a belt movement property and which is disposed downstream of the primary transfer portion with respect to the movement direction of the intermediary transfer belt 11. For this reason, during the tension correction, the speed fluctuation of the intermediary transfer belt is generated.

Parts (a) to (c) of FIG. 7 are schematic views each showing a surface speed state of the intermediary transfer belt 11 in the case where the tension fluctuation of the intermediary transfer belt 11 generated due to the tangential force fluctuation of the secondary transfer nip T is intended to be made constant by effecting the control in this embodiment. Parts (a) to (c) of FIG. 7 show, similarly as (a) to (c) of FIG. 6, the tension state of the intermediary transfer belt 11 at the portion (A), the state after the lapse of the time t, and the state after further lapse of the time t, respectively.

In this embodiment, in the case where the tension-relieved state of the intermediary transfer belt 11 at the portion (A) is detected, in order to eliminate the tension-relived state, the speed of the secondary transfer roller 20 is lowered. On the other hand, during the period, the secondary transfer opposite roller 13 is rotated in a steady state so that the speed of the intermediary transfer belt 11 is made constant. Therefore, as is understood from (a) to (c) of FIG. 7, in all the sections from the position "α" in (a) of FIG. 7 to the position "γ" in (c) of FIG. 7, the movement speed of the intermediary transfer belt 11 at the primary transfer portion is constant (Vαβ=Vβγ).

As described above, the driving source (for the intermediary transfer belt driving roller 12) which is provided downstream of the primary transfer portion and which has a large driving force dominantly controls the speed of the intermediary transfer belt 11 and ensures speed stability which is not affected by disturbance or the like. Further, the driving source (for the secondary transfer roller 20) which is provided upstream of the primary transfer portion and which has a small driving force is subjected to the rotational speed control on the basis of the tension detection result.

As a result, in the case where the rotational speed of the secondary transfer roller 20 is controlled, compared with the case where the rotational speed of the driving roller 12 is controlled, the speed fluctuation of the intermediary transfer belt 11 can be suppressed. For this reason, the tension fluctuation of the intermediary transfer belt 11 can be suppressed while suppressing the speed fluctuation of the intermediary transfer belt 11, so that the color misregistration and the transfer deviation can be suppressed.

Further, in the case where the driving roller 12 and the secondary transfer roller 20 are disposed at the same position or close positions, it is difficult to control the rotational speed and tension of the intermediary transfer belt 11 at a position remote from the driving roller 21 and the secondary transfer roller 20. However, in this embodiment, the driving roller 12 and the secondary transfer roller 20 are contacted to the intermediary transfer belt 11 at different positions (which are disposed upstream and downstream of the primary transfer portion and are remote from each other). As a result, the rotational speed and tension of the intermediary transfer belt 11 can be controlled at substantially the same level over the full circumference of the intermediary transfer belt 11.

(Driving Fore)

In this embodiment, tension information obtained by the tension detecting unit 19 is fed back to the secondary transfer roller 20 having the small driving force, not the intermediary transfer belt driving roller 12 having the large driving force.

The intermediary transfer belt driving roller 12 is disposed inside the intermediary transfer belt 11 and is disposed so that the intermediary transfer belt 11 is wound about the driving roller 12. Thus, the roller 21 has a portion where the intermediary transfer belt 11 is wounded about the roller 12 and therefore has the large driving force. A driving force $F_1$ of the roller 12 can be represented by an equation (1) shown below on the basis of the Euler's belt theory.

When a static friction coefficient between the surface of the roller 12 and the back (inner) surface of the intermediary transfer belt 11 is $\mu_1$, a winding angle of the intermediary transfer belt 11 is θ and a tension of the intermediary transfer belt 11 at a belt surface is T, the driving force $F_1$ is obtained by the following equation (1):

$$F_1 = T \cdot e^{\mu_1 \theta} \quad (1)$$

A driving force $F_2$ of the secondary transfer roller 20 disposed outside the intermediary transfer belt 11 is obtained by an equation (2) shown below when a total pressure of the secondary transfer nip is N and a static friction efficient between the surface of the secondary transfer roller 20 and the surface of the intermediary transfer belt 11 is $\mu_2$.

$$F_2 = \mu_2 \cdot N \quad (2)$$

In this embodiment, $\mu_1$=0.6, T–30 (N), 0=2.27 (rad)=130 (deg), $\mu_2$=0.5 and T=20 (N) and therefore $F_1$=117 (N) and $F_2$=10 (N) are obtained. As a result, $F_1 > F_2$ is satisfied.

(Secondary Transfer Roller 20)

The secondary transfer roller 20 was prepared by coating a 6 mm-thick electroconductive foam rubber layer on a core metal of SUS to have a hardness of 30 degrees (Asker-C hardness under load of 4.9 N (500 gf)), an outer diameter of 18 mm, and an electric resistance value of $1 \times 10^7 \Omega$. The secondary transfer roller 20 is urged in one direction by an unshown spring to form the secondary transfer nip T and is rotationally driven by the secondary transfer driving motor 29.

FIG. 10 is a sectional view of the secondary transfer roller 20 in another embodiment. Thus, the secondary transfer roller 20 is not limited to the above-described secondary transfer roller 20 but may also has the structure as shown in FIG. 10. The secondary transfer roller 20 shown in FIG. 10 includes a core metal 51 of SUS at a central (inner) portion, a primer layer 52 on the core metal 51, an NBR foam rubber layer 53 on the layer 52, a primer layer 54 on the layer 53 and a polyimide resin tube 55 on the layer 54.

The polyimide resin tube 55 as the outermost surface layer was 50 μm in thickness, about 0.3 μm in average surface roughness Tz, 18 mm in outer diameter and 65 degrees (Asker-C hardness under load of 9.8 N (1000 gf)). As a material for the surface layer, polyimide was used but other resin materials such as polycarbonate, polyvinylidene fluoride (PVDF), polyethylene, polypropylene, polyamide, polyalylate, polyethylene terephthalate, polyether sulfone and thermoplastic polyimide may also be used. Further, as the surface layer, it is possible to provide a curable layer of acrylic resin or the like and an elastic layer of a solid rubber or the like.

The secondary transfer roller 20 is the roller coated with the polyimide tube 55 and generates a high frictional force between itself and the intermediary transfer belt 11 formed of a similar resin material. This is because these surface resin materials have a high lubricating property and therefore a true contact area in the secondary transfer nip is large to increase a depositing force due to the Van der Waals force or the like.

In such a case, the tangential force fluctuation in the secondary transfer nip T is also increased, so that the tension fluctuation of the intermediary transfer belt 11 is also increased. Further, also in the case where the surface layer of the secondary transfer roller 20 is the coating layer and in the case where the solid rubber roller is used, similarly, the tangential force in the secondary transfer nip is also increased.

Incidentally, as the intermediary transfer belt 11, an endless resin belt which was adjusted to have a volume resistivity of about $10^{10}$ ohm·cm and was 100 μm in thickness was used. As a material for the belt, in this embodiment, PVDF was used but other resin materials such as polyimide polycarbonate, polyvinylidene fluoride (PVDF), polyethylene, polypropylene, polyamide, polyalylate, polyethylene terephthalate, polyether sulfone and thermoplastic polyimide may also be used. Further, on the surface of these layers, it is possible to provide a curable layer of acrylic resin or the like. Further, the intermediary transfer belt driving roller 12 was prepared by coating a 0.5 mm-thick EPDM rubber on a hollow aluminum pipe of 24 mm in outer diameter to have an electric resistance of $10^5 \Omega$ or less.

Incidentally, the present invention is not limited to the image forming apparatus using the intermediary transfer belt 11 but may also be, as shown in FIG. 11, an image forming apparatus using a sheet conveying belt (endless belt) 71 in place of the intermediary transfer belt 11. In the image forming apparatus, a sheet conveying belt driving roller (first driving member) 64 is provided in place of the intermediary transfer belt driving roller 12, an attraction roller (second driving member) 72 is provided in place of the secondary transfer roller 20, and an attraction opposite roller 203 is provide din place of the secondary transfer opposite roller 13.

The sheet conveying belt driving roller 64 has a conveying force larger than the attraction roller 72. The attraction roller 72 electrostatically attracts the conveyed sheet to a sheet conveying belt 71. The sheet conveying belt driving roller 64 is provided downstream of the primary transfer portion and the attraction roller 72 is provided upstream of the primary transfer portion. The rollers 64 and 72 are controlled similarly as in the above-described control.

Second Embodiment

An image forming apparatus according to the Second Embodiment of the present invention will be described with reference to FIG. 8. Portions similar to those in the First Embodiment are represented by the same reference numerals or symbols and will be omitted from redundant description. Parts (a) to (c) of FIG. 8 are illustrations of a speed of an intermediary transfer belt in this embodiment.

As shown in (a) to (c) of FIG. 8, in the image forming apparatus in this embodiment, in place of the tension detecting unit 19 in First Embodiment, a tension detecting unit (tension detecting means) 39 is provided. The tension detecting unit 39 is constituted by a tension roller (movable device) 15, a tension spring 16 and an optical distance measuring sensor 26.

The tension roller 15 is urged against the intermediary transfer belt 11 at a position downstream of the driving roller 12 with respect to the intermediary transfer belt movement direction to apply predetermined tension to the intermediary transfer belt 11 from the inside of the intermediary transfer belt 11. The optical distance measuring sensor 26 is provided outside the intermediary transfer belt 11 and detects the position of the tension roller 15 via the intermediary transfer belt 11.

In this embodiment, the tension roller 15 was 12 mm in outer diameter and was disposed so that the winding angle of the intermediary transfer belt 11 about the tension roller 15 was 70 degrees. As the tension spring 16, a spring capable of applying the tension of 20 N to the intermediary transfer belt 11 of 240 mm in width was selected. Further, the tension roller 15 was constituted in such a manner that a light-weight hollow pipe of aluminum was used to minimize the force of inertia and a shaft is freely movable so that the tension roller 15 can sensitively follow the tension fluctuation of the intermediary transfer belt 11. Further, as the tension spring 16 used, a spring having a small spring constant is selected to the possible extent, so that the tension spring 16 can urge the tension roller 15 with a certain force without changing a spring force when a spring length is fluctuationed.

Part (a) of FIG. 8 shows a balanced state in tension between the intermediary transfer belt 11 and the tension roller 15 in a state in which there is no tangential force in the secondary transfer nip T. Part (b) of FIG. 8 shows a state in which the speed of the secondary transfer roller 20 is increased from that in the state of (a) of FIG. 8 to generate the tangential force with respect to a direction (indicated by an arrow in (b) of FIG. 8) in which the speed of the intermediary transfer belt 11 toward the secondary transfer nip is increased. In this case, the tension of the intermediary transfer belt 11 in the neighborhood of the tension roller (portion (B) in (b) of FIG. 8) is increased and the tension between the secondary transfer opposite roller and the photosensitive drum 2Y (portion (A) in (b) of FIG. 8) is lowered.

Part (c) of FIG. 8 shows a state in which the speed of the secondary transfer roller 20 is decreased from that in the state of (a) of FIG. 8 to generate the tangential force with respect to a direction (indicated by an arrow in (c) of FIG. 8) in which the speed of the intermediary transfer belt 11 toward the secondary transfer nip is decreased. In this case, the tension of the intermediary transfer belt 11 in the neighborhood of the tension roller (portion (B) in (c) of FIG. 8) is decreased and the tension between the secondary transfer opposite roller and the photosensitive drum 2Y (portion (A) in (c) of FIG. 8) is increased.

The position of the tension roller 15 is detected by the optical distance measuring sensor 26, so that the tension of the intermediary transfer belt q11 in the neighborhood of the tension roller 15 (at the portion (A) in FIG. 8) is detected. As a result, from the change in tension of the intermediary transfer belt 11, the tension state of the intermediary transfer belt 11 at the position ((A) in FIG. 8) between the secondary transfer opposite roller 13 and the photosensitive drum 2Y can be detected.

As a result, also in this embodiment, similarly as in the First Embodiment, the speed fluctuation of the intermediary transfer belt with the tension correction an be suppressed over the entire image formation simultaneously with the suppression of the tension fluctuation of the intermediary transfer belt, so that it is possible to suppress the color misregistration and the transfer deviation.

Third Embodiment

An image forming apparatus according to the Third Embodiment of the present invention will be described with reference to FIG. 8. Portions similar to those in the First Embodiment are represented by the same reference numerals or symbols and will be omitted from redundant description. Parts (a) to (c) of FIG. 9 are illustrations of a speed of an intermediary transfer belt in this embodiment.

As shown in (a) to (c) of FIG. 8, in the image forming apparatus in this embodiment, in place of the tension detecting unit 19 in the First Embodiment, a tension detecting unit (tension detecting means) 59 is provided. Further, in place of the tension roller 15, a stretching roller 46 is provided. The tension detecting unit 59 includes tension detecting roller surface 61 and 62, a connecting member 43, a tension positioning member 45 and an optical (infrared) distance measuring sensor 26. Here, the tension detecting rollers 61 and 62 and the connecting member 43 constitute a movable device.

The tension detecting roller 61 is provided in contact to the intermediary transfer belt 11 at a position ((A) in FIG. 9) between the secondary transfer opposite roller 13 and the photosensitive drum 2Y. The tension detecting roller 62 in contact to the intermediary transfer belt 11 at a position ((c) in FIG. 9) below the tension detecting roller 61 and upstream of the follower roller 14 with respect to the rotational direction of the intermediary transfer belt 11.

The connecting member 43 connects the tension detecting rollers 61 and 62. The tension detecting rollers 61 and 62 and the connecting member 43 are configured so that their positions are determined depending on the balance with the tension of the intermediary transfer belt 11.

The detecting member 45 is connected to the connecting member 43 at one end portion thereof, so that the connecting member 43 capable of being moved vertically by the tension of the intermediary transfer belt 11 is rotationally moved about a rotation center 44 depending on a degree of movement thereof. The infrared distance measuring sensor 26 detects the other end of the tension detecting member 45.

The stretching roller 46 is fixedly provided at a position where it stretches the intermediary transfer belt 11, so that the tension of the intermediary transfer belt 11 is applied by urging the intermediary transfer belt 11 with the tension detecting rollers 61 and 62. In this embodiment, the tension detecting rollers 61 and 62 enter, during a rest state of the image forming apparatus, the intermediary transfer belt 11 at the portions (A) and (C) in FIG. 9, respectively, by about 1 mm. As a result, the tension of 20 N is obtained on the intermediary transfer belt 11 with a width of 240 mm.

Part (a) of FIG. 9 shows a balanced state in tension between the intermediary transfer belt 11 and the tension detecting rollers 61 and 62 in a state in which there is no tangential force in the secondary transfer nip T. Part (b) of FIG. 9 shows a state in which the speed of the secondary transfer roller 20 is decreased from that in the state of (a) of FIG. 9 to generate the tangential force with respect to a direction (indicated by an arrow in (b) of FIG. 9) in which the speed of the intermediary transfer belt 11 toward the secondary transfer nip is decreased. In this case, the tension of the intermediary transfer belt 11 at the portion (A) in (b) of FIG. 9) is increased and the tension at the portion (C) in (b) of FIG. 9) is lowered. For this reason, the tension detecting rollers 61 and 62 and the connecting member 43 are moved downward. In synchronism with the motion of the connecting member 43, the tension detecting member 45 is rotationally moved, so that the other end portion of the tension detecting member 45 is moved toward the optical distance measuring sensor 26.

Part (c) of FIG. 9 shows a state in which the speed of the secondary transfer roller 20 is decreased from that in the state of (a) of FIG. 8 to generate the tangential force with respect to a direction (indicated by an arrow in (c) of FIG. 9) in which the speed of the intermediary transfer belt 11 toward the secondary transfer nip is increased. In this case, the tension at the portion (A) in (c) of FIG. 9) is decreased and the tension at the portion (C) in (c) of FIG. 9) is increased. For this reason, the tension detecting rollers 61 and 62 and the connecting member 43 are moved upward. In synchronism with the motion of the connecting member 43, the tension detecting member 45 is rotationally moved, so that the other end portion of the tension detecting member 45 is moved away from the optical distance measuring sensor 26.

As described above, by detecting the position of the other end portion of the tension detecting member 45 by the optical distance measuring sensor 26, so that the tension of the intermediary transfer belt, the tension (state) of the intermediary transfer belt 11 at the position ((A) in FIG. 9) between the secondary transfer opposite roller 13 and the photosensitive drum 2Y can be detected.

As a result, also in this embodiment, similarly as in the First Embodiment, the speed fluctuation of the intermediary transfer belt with the tension correction an be suppressed over the entire image formation simultaneously with the suppression of the tension fluctuation of the intermediary transfer belt, so that it is possible to suppress the color misregistration and the transfer deviation.

Further, the tension detecting unit 59 in this embodiment performs the tension detection at the position of the tension detecting member 45 determined by the balance of tension at each of the two positions of the intermediary transfer belt 11. That is, the tension detection is performed only by using the tension of the intermediary transfer belt 11 without via the spring or the like and therefore it becomes possible to perform high-responsive detection with high accuracy.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 152847/2011 filed Jul. 11, 2011, which is hereby incorporated by reference.

What is claimed is:

1. An image forming apparatus comprising:

an image bearing member for bearing a toner image;

a rotatable endless belt;

a first driving member for rotationally driving said endless belt and in contact with an inner peripheral surface of said endless belt;

a second driving member, provided at a position different from a position of said first driving member with respect to a rotational direction of said endless belt, for rotationally driving said endless belt and in contact with an outer peripheral surface of said endless belt;

a tension detecting unit for detecting a state of tension of said endless belt; and a controller for controlling a rotational speed of said second driving member, wherein a driving force applied from said second driving member to said endless belt is smaller than a driving force applied from said first driving member to said endless belt, wherein said tension detecting unit includes a metal roller contacting the inner peripheral surface of said endless belt and detects the tension by movement of said metal roller which follows said endless belt, and wherein said controller controls, on the basis of a detection result of said tension detecting unit, the rotational speed of said second driving member so that the state of tension of said endless belt is a predetermined state.

2. An apparatus according to claim 1, wherein said controller lowers the rotational speed of said second driving member when said tension detecting unit detects a tension-relieved state of said endless belt.

3. An apparatus according to claim 1, wherein said controller increases the rotational speed of said second driving member when said tension detecting unit detects a tension state of said endless belt.

4. An apparatus according to claim 1, wherein said tension detecting unit includes a movable member engageable with the metal roller and movable in synchronism with movement of the metal roller.

5. An apparatus according to claim 4, wherein said tension detecting unit includes a tension detecting member interrelated with said movable device, and a detecting device for detecting a distance from said tension detecting member.

6. An apparatus according to claim 1, wherein said endless belt is an intermediary transfer belt onto which the toner image is to be primary-transferred from said image bearing member, and wherein said second driving member is a secondary transfer roller for secondary-transferring the toner image from said intermediary transfer belt onto a recording material.

7. An apparatus according to claim 6, further comprising a transfer device for primary-transferring the toner image from said image bearing member onto said intermediary transfer belt, wherein said tension detecting unit includes a movable device, provided downstream of said second driving member and upstream of said transfer device with respect to a rotational direction of said endless belt, movable depending on the state of tension of said endless belt in contact with said endless belt.

8. An apparatus according to claim 1, wherein said endless belt is a sheet conveying belt for conveying a sheet onto which the toner image is to be transferred from said image bearing member.

9. An image forming apparatus comprising:

an image bearing member for bearing a toner image;

a rotatable endless belt;

a first driving member for rotationally driving said endless belt and in contact with an inner peripheral surface of said endless belt;

a second driving member, provided at a position different from a position of said first driving member with respect to a rotational direction of said endless belt, for rotationally driving said endless belt and in contact with an outer peripheral surface of said endless belt;

a tension roller, provided in contact with the inner peripheral surface of said endless belt, for applying tension to said endless belt by being urged by a spring;

a tension detecting unit for detecting a state of tension of said endless belt; and a controller for controlling a rotational speed of said second driving member, wherein a driving force applied from said second driving member to said endless belt is smaller than a driving force applied from said first driving member to said endless belt, wherein said tension detecting unit includes an optical sensor, opposing said tension roller via said endless belt, for measuring a distance to the outer peripheral surface of said endless belt, and wherein said controller controls, on the basis of a detection result of said optical sensor, the rotational speed of said second driving member.

10. An apparatus according to claim 9, wherein said tension roller is provided downstream of said first driving member and upstream of said second driving member with respect to a rotational direction of said endless belt.

* * * * *